US009754576B2

(12) United States Patent
Weston

(10) Patent No.: US 9,754,576 B2
(45) Date of Patent: Sep. 5, 2017

(54) CONTROL SYSTEM FOR NOISE GENERATED BY FUNCTIONAL HARDWARE COMPONENTS

(71) Applicant: Ford Global Technologies, LLC, Dearborn, MI (US)

(72) Inventor: Keith Weston, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 24 days.

(21) Appl. No.: 14/665,208

(22) Filed: Mar. 23, 2015

(65) Prior Publication Data

US 2016/0284333 A1 Sep. 29, 2016

(51) Int. Cl.
*H04R 1/10* (2006.01)
*G10K 11/178* (2006.01)

(52) U.S. Cl.
CPC .... *G10K 11/1782* (2013.01); *G10K 2210/129* (2013.01); *G10K 2210/1282* (2013.01); *G10K 2210/30231* (2013.01)

(58) Field of Classification Search
CPC ..... G10K 2210/10; G10K 2210/105; G10K 2210/128; G10K 2210/1281; G10K 2210/1282; G10K 2210/1283; G10K 11/1784; G10K 11/175; G10K 11/1788
USPC ..... 381/71.1, 71.2, 71.3, 71.4, 71.11, 71.12, 381/71.13
See application file for complete search history.

(56) References Cited

U.S. PATENT DOCUMENTS

| | | | | |
|---|---|---|---|---|
| 5,485,523 | A | 1/1996 | Tamamura et al. | |
| 6,654,054 | B1 * | 11/2003 | Embler | H04N 5/3577 348/241 |
| 7,106,868 | B2 | 9/2006 | Daly | |
| 7,352,874 | B2 | 4/2008 | Raptopolous et al. | |
| 2005/0259830 | A1 | 11/2005 | Vaishya | |
| 2010/0082873 | A1 * | 4/2010 | Rosen | H04L 12/40182 710/313 |
| 2012/0027220 | A1 * | 2/2012 | Sugawara | G10K 11/1784 381/71.1 |
| 2012/0237049 | A1 * | 9/2012 | Brown | G10K 11/1788 381/71.1 |
| 2013/0287217 | A1 * | 10/2013 | Lee | G10K 11/178 381/71.1 |

(Continued)

FOREIGN PATENT DOCUMENTS

WO 2013030729 A2 3/2013

OTHER PUBLICATIONS

Tongwei Wang, et al., Psychoacoustic Active Noise Control System with Auditory Masking, DSP Lab, School of Electrical and Electronic Engineering, Nanyang Technological University, Singapore.

*Primary Examiner* — William A Jerez Lora
(74) *Attorney, Agent, or Firm* — Frank A. MacKenzie; Brooks Kushman P.C.

(57) ABSTRACT

A system includes a microphone, a controller, and a speaker. The microphone is configured to detect noise generated by a functional hardware component due to user interaction with the component. The controller is configured to identify the component from the noise and obtain a noise cancelling signal pre-associated with identification of the component. The speaker is configured to output a noise cancelling sound based on the noise cancelling signal whereby the noise is attenuated.

15 Claims, 5 Drawing Sheets

(56) References Cited

U.S. PATENT DOCUMENTS

| | | | | |
|---|---|---|---|---|
| 2015/0264499 | A1* | 9/2015 | Valeri | G10K 11/178<br>381/58 |
| 2015/0332564 | A1* | 11/2015 | Weinberg | G08B 6/00<br>340/407.1 |
| 2015/0355649 | A1* | 12/2015 | Ovadia | G05D 23/1917<br>704/233 |
| 2016/0198030 | A1* | 7/2016 | Kim | G10L 21/0216<br>379/392.01 |

* cited by examiner

CONTROL SYSTEM FOR NOISE GENERATED BY FUNCTIONAL HARDWARE COMPONENTS

TECHNICAL FIELD

The present disclosure relates to vehicular active noise control systems.

BACKGROUND

As vehicle interiors and cabins become quieter, noises made by functional hardware components (e.g., switches, closures, compartments, seat adjustments, pedal applications, gear selectors, tactile interfaces) become increasingly in focus. A desire is that either no sound or a pleasant and engaging sound is made during use of functional hardware components.

SUMMARY

A system includes a microphone, a controller, and a speaker. The microphone is configured to detect noise generated by a functional hardware component due to user interaction with the component. The controller is configured to identify the component from the noise and obtain a noise cancelling signal pre-associated with identification of the component. The speaker is configured to output a noise cancelling sound based on the noise cancelling signal whereby the noise is attenuated.

The controller may be further configured to identify the component from the noise by comparing the noise with a plurality of pre-stored sounds associated with identification of a plurality of functional hardware components. The controller may be further configured to obtain the noise cancelling signal by comparing the identification of the component with identification of a plurality of functional hardware components associated with a plurality of noise cancelling signals.

The system may further include a bus communicating information regarding the component. The controller may be further configured to identify the component from the information communicated on the bus.

The component may be one of a switch, a closure, a compartment, a seat adjustor, a pedal, a gear selector, and a tactile interface.

The system may further include a vibration sensor configured to detect vibrations. The controller may be further configured to detect the noise from the vibrations detected.

A vehicle includes a functional hardware component within an interior cabin of the vehicle. The vehicle further includes the system described above.

A method includes detecting noise generated by a functional hardware component and identifying the component from the noise. The method further includes obtaining a noise cancelling signal pre-associated with identification of the component and outputting a noise cancelling sound based on the noise cancelling signal whereby the noise is attenuated.

DETAILED DESCRIPTION

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
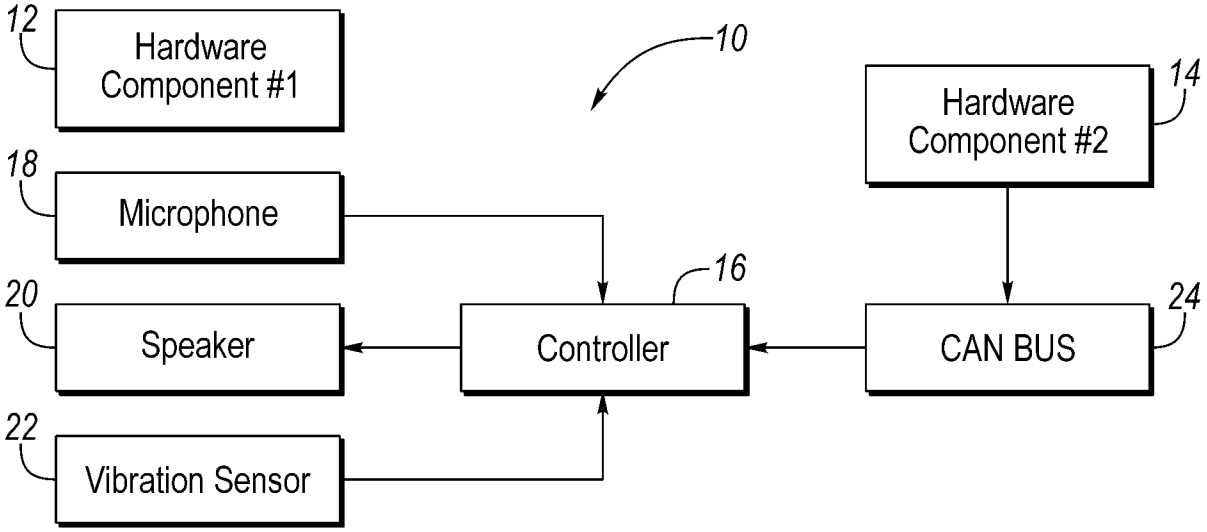
FIG. 1 illustrates a block diagram of a noise control system for noise generated by functional hardware components.

Referring now to FIG. 1, a block diagram of a noise control system 10 is shown. Noise control system 10 is for controlling noise generated by functional hardware components. The hardware components may be within the interior or cabin of a vehicle. The hardware components generate noise as a result of user interaction with the components or generate noise during operation of the components. Hardware components which generate noise from user interaction include: switches; closures such as doors, deck lids, lift gates, and moon roofs; compartments such as storage, glove box, and coin trays; seat adjustments including heated, cooled, and massaging seats; pedal applications including user interface with the pedals (e.g., feet on pedals, feet movement on carpet/floor mats); gear selectors; and tactile interfaces. Hardware components which generate noise during operation include fans, blowers, motors, and adjustors.

A first functional hardware component 12 and a second functional hardware component 14 are illustrated in FIG. 1 in association with noise control system 10. Hardware components 12 and 14 may be hardware components which generate noise as a result of user interaction with the components or which generate a noise during operation of the components. In the former case, the noise is a transient noise as the noise lasts as long as the user interaction with the hardware component. In the latter case, the noise is a steady noise as the noise lasts during operation of the hardware component. Noise itself is a type of sound which typically is undesired. Hardware components 12 and 14 are representative of any number or types of functional hardware components in association with noise control system 10.

Control system 10 includes a controller 16, an audio sub-system including at least one microphone 18 and at least one speaker 20, and a vibration sub-system including at least one vibration sensor 22. Microphone 18 is configured to detect noise (or sound) heard in an environment. Speaker 20 is configured to output sound into the environment. Vibration sensor 22 is configured to detect vibrations of a device or vibrations caused by the device. The vibrating device may generate noise in the environment as a result of the vibration. As such, vibration sensor 22 may be used to indirectly detect noise heard in an environment. Controller 16 is in communication with the components of the audio and vibration sub-systems including microphone 18, speaker 20, and vibration sensor 22.

Controller 16 is configured to perform active noise control (ANC) functions to cancel noise heard in an environment. For an ANC function, microphone 18 detects the noise and provides a noise signal indicative of the detected noise to controller 16. Controller 16 generates a noise cancelling signal based on the detected noise and provides the noise cancelling signal to speaker 20. Speaker 20 outputs a noise cancelling sound based on the noise cancelling signal into the environment. The noise cancelling sound is intended to be opposite in phase and same amplitude as the noise whereby the noise cancelling sound cancels the noise and no sound is heard.

Controller 16 is further configured to perform active sound control (ASC) functions to enhance a sound heard in an environment. For an ASC function, microphone 18 detects the sound and provides a sound signal indicative of the detected sound to controller 16. Controller 16 generates a sound enhancement signal based on the detected sound and provides the sound enhancement signal to speaker 20. Speaker 20 outputs an enhancement sound based on the sound enhancement signal into the environment. The enhancement sound is intended to enhance specific spatial and temporal characteristics of the original sound whereby an enhanced sound is heard in place of the original sound.

Controller 16 is further configured to perform active mask control (AMC) functions to mask noise heard in an environment. For an AMC function, microphone 18 detects the noise and provides a noise signal indicative of the detected noise to controller 16. Controller 16 generates a masking sound signal based on the detected noise and provides the masking sound signal to speaker 20. Speaker 20 outputs a masking sound based on the masking sound signal into the environment. The masking sound is intended to mask the noise whereby the masking sound is heard in place of the noise.

In the vehicular implementation of control system 10 shown in FIG. 1, controller 16 is further in communication with a vehicle network (e.g., a controller area network (CAN)) bus 24. Various types of information from vehicle controllers, sensors, devices, etc., is communicated over CAN bus 24. In the implementation shown in FIG. 1, information regarding operation, status, usage, etc., of second hardware component 14 is communicated over CAN bus 24. Controller 16 is apprised of the operating condition of second hardware component 14 from the information (switch usage, on/off status, low/medium/high output level, etc.) regarding the second hardware component communicated over CAN bus 24. In this way, controller 16 is directly apprised of the operating condition of second hardware component 14 during a given time.

First hardware component 12 is not in communication with CAN bus 24 in the implementation shown in FIG. 1. As such, controller 16 is not directly apprised of the operating condition of first hardware component 14 through CAN bus 24. However, controller 16 is indirectly apprised of the operating condition of first hardware component 14 via microphone 18. In this regard, microphone 18 detects the noise (or sound) generated by first hardware component 14 and provides a noise signal indicative of the detected noise to controller 16. Upon recognizing and associating the noise with operation of first hardware component 12 (described in greater detail below), controller 16 is apprised of the operating condition of the first hardware component.

Figure 2:
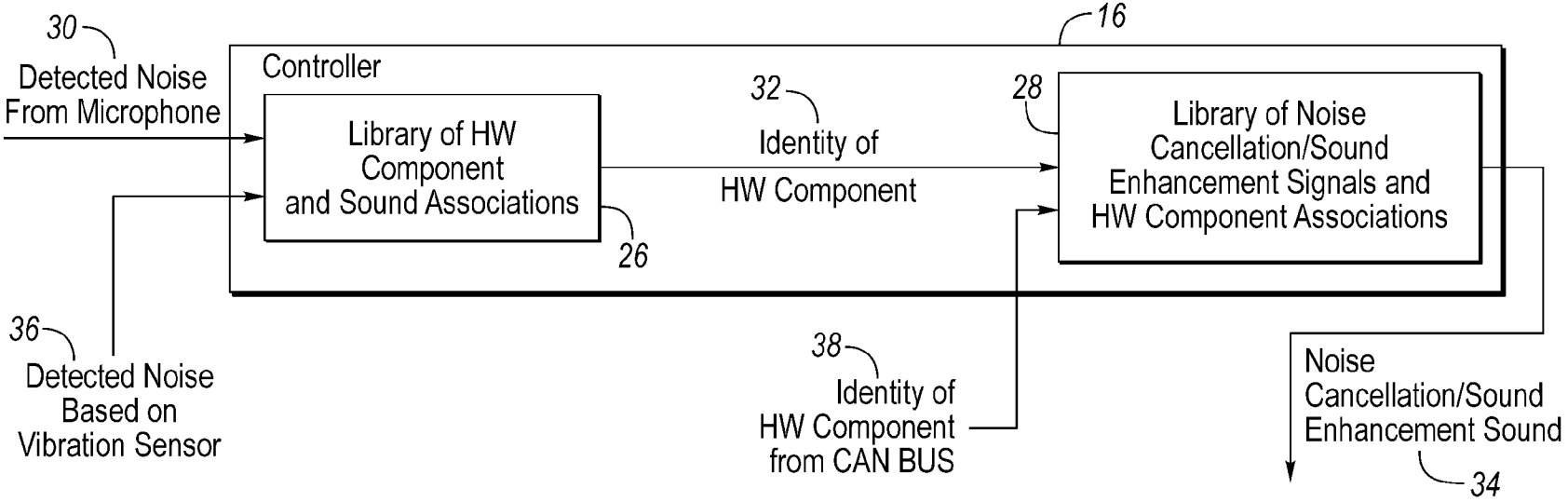
FIG. 2 illustrates a block diagram depicting in greater detail the controller of the noise control system and its operation.

Referring now to FIG. 2, with continual reference to FIG. 1, a block diagram depicting in greater detail controller 16 and its operation is shown. Controller 16 includes memory having a first library 26 and a second library 28. First library 26 is a library of hardware component and sound associations. First library 26 includes a list of hardware components and a corresponding list of sounds. That is, first library 26 includes one or more pairs of information with each pair including an identification of a hardware component and a sampling of the sound generated by that hardware component during a given operating condition. The sampling of the sound generated by the hardware component is a sampling of the actual sound generated as a result of either user interaction with that hardware component or operation of that hardware component. For example, the list of hardware components of first library 26 includes first hardware component 12 and second hardware component 14. In this case, the corresponding list of sounds includes a sampling of the actual (transient or steady) sound generated by first hardware component 12 during a given operating condition and a sampling of the actual (transient or steady) sound generated by second hardware component 14 during a given operating condition.

Second library 28 of controller 16 is a library of noise cancellation and/or sound enhancement (NC/SE) signals and hardware component associations. Second library 28 includes a list of NC/SE signals and a corresponding list of hardware components. That is, second library 28 includes one or more pairs of information with each pair including a NC/SE signal and an identification of a hardware component. The NC/SE signal represents a noise cancelling sound and/or an enhancement sound which when outputted by speaker 20 cancels/enhances the sound generated by the corresponding hardware component during a given operating condition. The sound generated by the corresponding hardware component is the sound generated either as a result of user interaction with that hardware component or operation of that hardware component. For example, the corresponding list of hardware components of second library 28 includes first hardware component 12 and second hardware component 14. In this case, the list of NC/SE signals includes a first NC/SE signal for cancelling/enhancing the sound generated by first hardware component 12 and a second NC/SE signal for cancelling/enhancing the sound generated by second hardware component 14.

As described, a functional hardware component generates noise as a result of either user interaction with the hardware component or operation of the hardware component. Controller 12 is configured to control speaker 20 to output a sound which cancels, enhances, or masks the noise generated by the hardware component. In operation, microphone 18 detects the noise generated by the hardware component and provides a noise signal indicative of the detected noise to controller 16 as indicated by reference numeral 30 in FIG. 2. Controller 16 accesses first library 26 of hardware component and sound associations. The noise signal indicative of the detected noise is inputted into first library 26 as controller 16 compares the noise signal with the sound samplings in the first library. Upon finding a match between the detected noise and a sound sampling, controller 16 thereby identifies the hardware component generating the detected noise. This hardware component is paired in first library 26 with the matching sound sampling. The identity of the hardware component is outputted from first library 26 and inputted into second library 28 as indicated by reference numeral 32.

Controller 16 accesses second library 28 of NC/SE signals and hardware component associations with the identity of the hardware component. Controller 16 compares the hardware component identity with the listed hardware components in second library 28. Upon finding a hardware component listed in second library 28 corresponding to the hardware component identity, controller 16 thereby learns the NC/SE signal for cancelling/enhancing the noise generated by the hardware component. The NC/SE signal is paired in second library 28 with the hardware component.

In turn, controller 16 provides the NC/SE signal to speaker 20 as indicated by reference numeral 34. Speaker 20 outputs a noise cancelling sound or an enhancement sound based on the NC/SE signal. The noise cancelling sound is intended to cancel the noise generated by the hardware component whereby no sound is heard. The enhancement sound is intended to enhance specific characteristics of the noise generated by the hardware component whereby an enhanced sound is heard in place of the noise.

As described above, vibration sensor 22 can indirectly detect noise generated by a hardware component by detecting vibrations of the hardware component which cause the noise to be generated. As such, vibration sensor 22 can provide a vibration signal which is indicative of the generated noise to controller 16 as indicated by reference numeral 36 in FIG. 2. Controller 16 accesses first library 26 to find a sound sampling in the first library matching the noise in order to identify the hardware component generating the noise. In turn, controller 16 accesses second library 28 to find a NC/SE signal for cancelling/enhancing the sound generated by the hardware component.

As described, a purpose of first library 26 is to identify the hardware component generating a noise. The identification is done by comparing the generated noise with sound samplings in first library 26. Upon finding a match between the generated noise and a sound sampling and thereby identifying the hardware component associated with the sound sampling, the identity of the hardware component generating the noise is discerned.

As such, the process involving first library 26 can be skipped when the identity of the hardware component generating the noise is communicated over CAN bus 24. For instance, operation information regarding second hardware component 14 is communicated over CAN bus 24 to controller 16. Controller 16 can thereby be made aware of the current operating condition of second hardware component 14. In particular, controller 16 is made aware that second hardware component 14 is operating and therefore deduces that the second hardware component is generating noise due to its operation. In turn, controller 16 accesses second library 28 with the identity of second hardware component 14 as indicated by reference numeral 38 to find a NC/SE signal for cancelling/enhancing the sound generated by the second hardware component.

Figure 3:
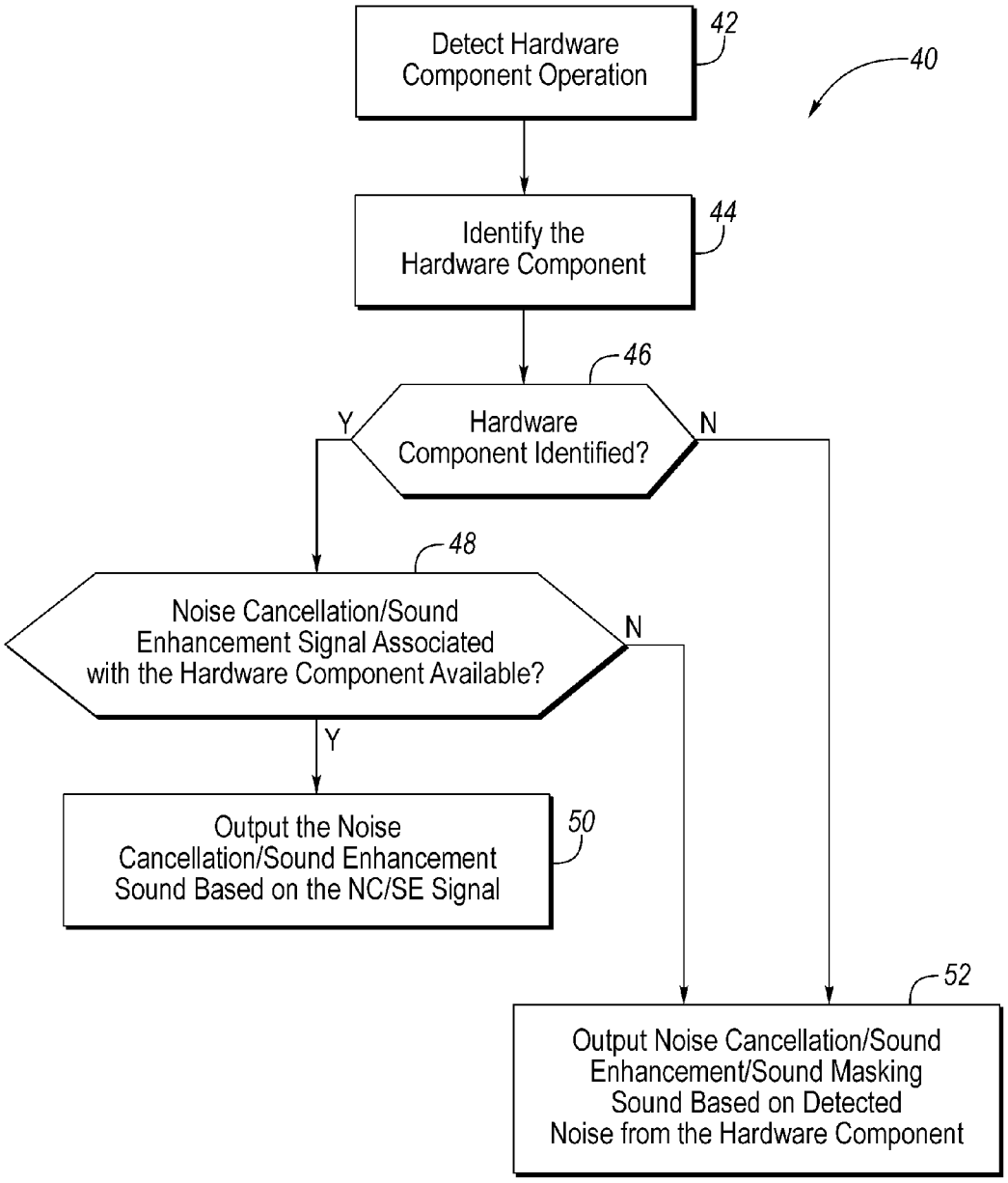
FIG. 3 illustrates a flowchart describing operation of the noise control system.

Referring now to FIG. 3, with continual reference to FIGS. 1 and 2, a flowchart 40 describing operation of noise control system 10 is shown. The operation of noise control system 10 as set forth in flowchart 40 begins with detecting a hardware component operating as set forth in block 42. Detecting operation of the hardware component is done via microphone 18 detecting noise generated by the hardware component, vibration sensor 22 detecting vibrations generated by the hardware component, or information communicated over CAN bus 24 regarding the status of the hardware component.

The operation of noise control system 10 continues with controller 16 identifying the hardware component that is operating as set forth in block 44. Controller 16 identifies the hardware component that is operating from the noise detected by microphone 18, the vibrations detected by vibration sensor 22, or information communicated over CAN bus 24. In the case of using noise detected by microphone 18, controller 16 compares the detected noise with the sound samplings in first library 26 to identify the hardware component. In the case of using vibrations detected by vibration sensor 22, controller 16 compares noise based on the detected vibrations with the sound samplings in first library 26 to identify the hardware component. The information communicated over CAN bus 24 includes the identity of the hardware component.

A decision is made in decision block 46 as to whether the hardware component is able to be identified. For instance, the hardware component cannot be identified when the detected noise does not match any of the sound samplings in first library 26 and no identifying information is available from CAN bus 24.

In the case the hardware component is able to be identified, the operation of noise control system 10 continues with decision block 48. A decision is made in decision block 48 as to whether a NC/SE signal associated with the hardware component is available. Controller 16 accesses second library 28 with the identity of the hardware component to find the NC/SE signal for cancelling/enhancing the noise generated by the hardware component.

If the NC/SE signal associated with the hardware component is found, then the operation of noise control system 10 continues with outputting from speaker 20 a noise cancelling/sound enhancement sound based on the NC/SE signal as set forth in block 50. In this case, controller outputs the NC/SE signal to speaker 20 which in turn outputs the noise cancelling/sound enhancement sound based on the NC/SE signal.

If the NC/SE signal associated with the hardware component is not found, then the operation of noise control system 10 continues with outputting from speaker 20 a noise cancelling/sound enhancement/sound masking sound based directly on detected noise generated by the hardware component as shown in block 52. That is, controller 16 applies typical noise cancelling/sound enhancement/sound masking techniques. For instance, controller 16 performs an ANC function based on the noise as detected by microphone 18 to output from speaker 20 a noise cancelling sound to cancel the noise. The operation of noise control system 10 pursuant to block 52 also occurs in the event that the hardware component is not able to be identified in decision block 46.

Figure 4A:
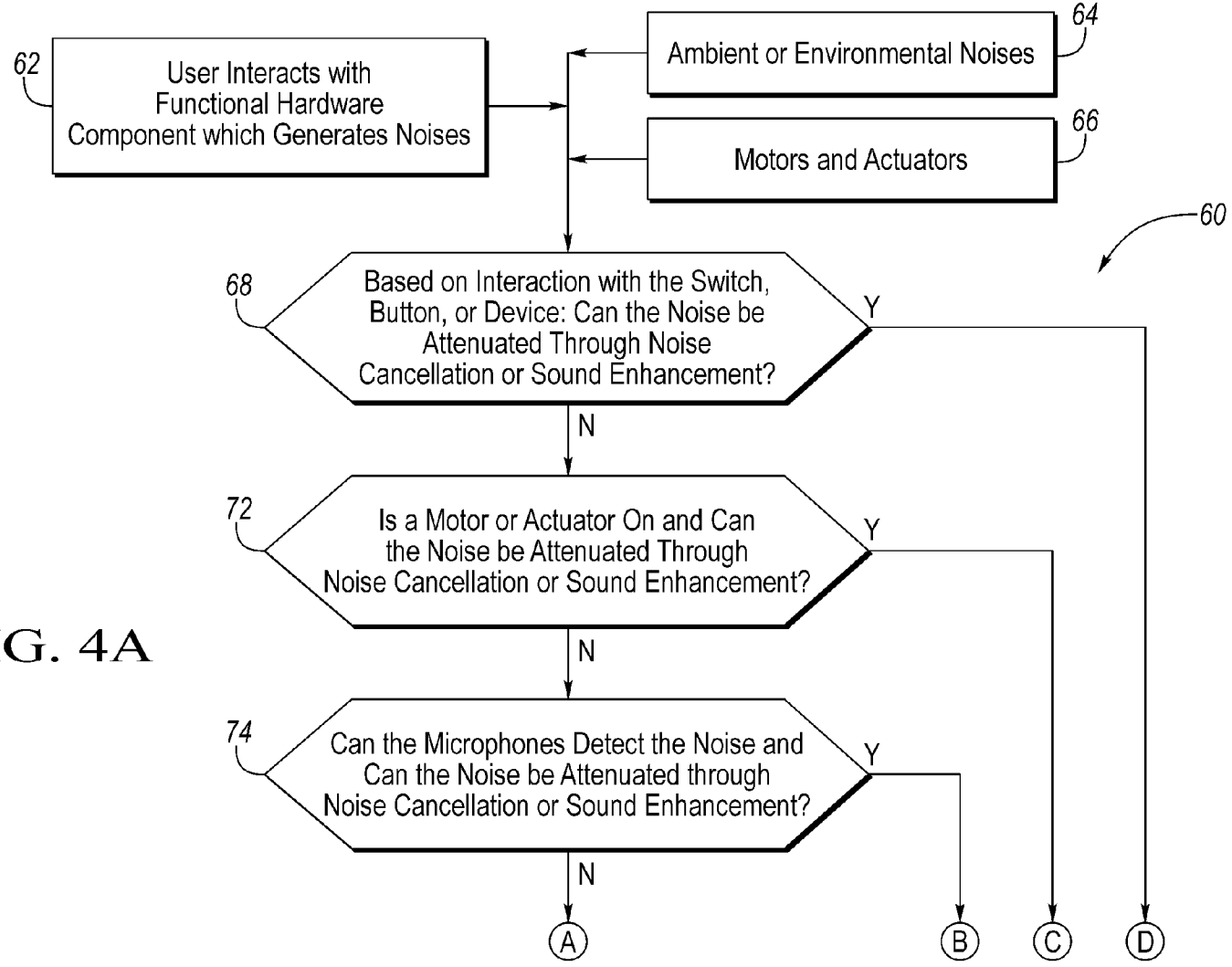
FIGS. 4A and 4B illustrate a flowchart further describing operation of the noise control system.
Figure 4B:
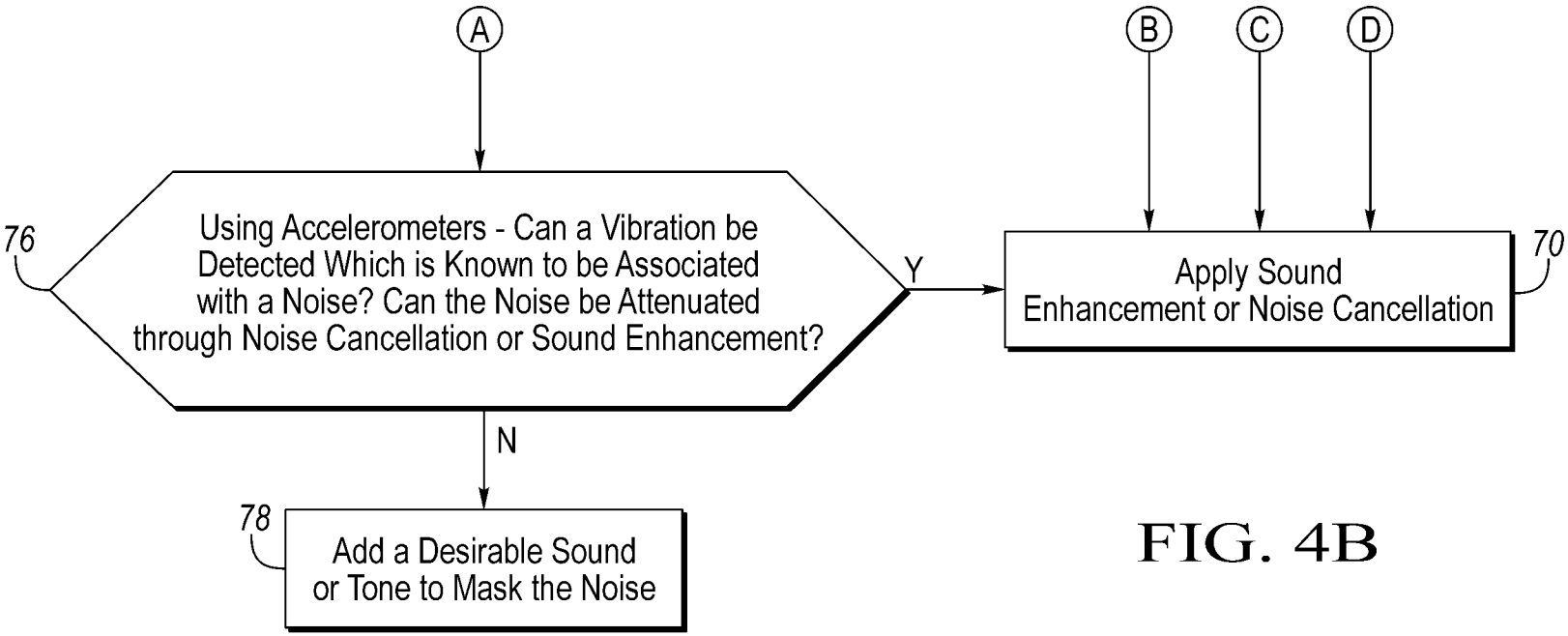

Referring now to FIGS. 4A and 4B, with continual reference to FIGS. 1, 2, and 3, a flowchart 60 further describing operation of noise control system 10 is shown. The operation of noise control system 10 as set forth in flowchart 60 begins with detecting noise. The noise may be generated by a hardware component as a result of a user interacting with the hardware component as set forth in block 62. Such hardware components include switches, closures, compartments, seat adjustments, pedal applications, gear selectors, and tactile interfaces. The noise may be an ambient or environmental noise such as wind noise, whistles, buffeting, road noise, etc. as set forth in block 64. The noise may be generated from a hardware components resulting from operation of the hardware component. Such hardware components include motors and actuators including fans, blowers, motors, and adjustors.

The operation continues with block 68 which inquires whether noise resulting from user interaction with a hardware component can be attenuated through noise cancellation or sound enhancement. If yes, then noise cancellation or sound enhancement is applied as indicated in block 70. Otherwise, the operation continues with block 72 which inquires whether noise resulting from operation of a hardware component can be attenuated through noise cancellation or sound enhancement. If yes, then noise cancellation or sound enhancement is applied as indicated in block 70. Otherwise, the operation continues with block 74 which inquires whether noise detected from microphone 18 can be attenuated through noise cancellation or sound enhancement. If yes, then noise cancellation or sound enhancement is applied as indicated in block 70. Otherwise, the operation continues with block 76 which inquires whether noise indirectly detected via vibration sensor 22 can be attenuated through noise cancellation or sound enhancement. If yes, then noise cancellation or sound enhancement is applied as indicated in block 70. Otherwise, sound masking is applied as indicated in block 78.

While exemplary embodiments are described above, it is not intended that these embodiments describe all possible forms of the present invention. Rather, the words used in the specification are words of description rather than limitation, and it is understood that various changes may be made without departing from the spirit and scope of the invention. Additionally, the features of various implementing embodiments may be combined to form further embodiments of the present invention.

What is claimed is:

1. A method comprising:

detecting noise generated by a functional hardware component in a vehicle during user interaction with the component;

identifying the component from the noise by comparing the noise with pre-stored sound samplings associated with identification of functional hardware components;

obtaining a noise cancelling signal pre-associated with the component by comparing identification of the component with identification of functional hardware components associated with pre-stored noise cancelling signals;

outputting a noise cancelling sound based on the noise cancelling signal.

2. The method of claim 1 wherein:

the noise is detected using a microphone.

3. The method of claim 1 further comprising:

detecting vibrations by a vibration sensor; and wherein the noise is detected from the vibrations detected.

4. The method of claim 1 further comprising:

identifying the component from information communicated on a bus.

5. The method of claim 1 further comprising:

outputting a sound masking sound when a pre-stored noise cancelling signal associated with identification of the component is unavailable.

6. The method of claim 1 further comprising:

outputting a noise cancelling sound based on the noise as detected when a pre-stored noise cancelling signal associated with identification of the component is not available.

7. The method of claim 1 wherein:

the noise cancelling sound includes a sound enhancement sound.

8. A system comprising:

a microphone to detect noise generated by a functional hardware component in a vehicle during user interaction with the component;

a library having identification of functional hardware components and associated pre-stored noise cancellation signals;

a controller to identify the component from the noise and obtain the pre-stored noise cancelling signal associated with identification of the component; and a speaker to output a noise cancelling sound based on the pre-stored noise cancelling signal.

9. The system of claim 8 further comprising:

a vibration sensor configured to detect vibrations; and wherein the controller is further configured to detect the noise from the vibrations detected.

10. The system of claim 8 wherein:

the library further includes pre-stored sounds associated with identification of functional hardware components; and the controller is further configured to identify the component from the noise by comparing the noise with the pre-stored sounds.

11. The system of claim 8 further comprising:

a bus communicating information regarding the component; and wherein the controller is further configured to identify the component from the information communicated on the bus.

12. The system of claim 8 wherein:

the component is one of a switch, a closure, a compartment, a seat adjustor, a pedal, a gear selector, and a tactile interface.

13. A vehicle comprising:

a functional hardware component within an interior cabin of the vehicle;

a microphone configured to detect noise generated by the component during user interaction with the component;

a first library having pre-stored sound samplings associated with identification of functional hardware components;

a second library having identification of functional hardware components associated with pre-stored noise cancellation signals;

a controller configured to identify the component from the noise by comparing the noise with the pre-stored sound samplings associated with identification of functional hardware components of the first library and obtain from the second library the pre-stored noise cancelling signal pre-associated with identification of the component by comparing the identification of the component with identification of functional hardware components associated with the pre-stored noise cancelling signals; and a speaker configured to output a noise cancelling sound based on the noise cancelling signal whereby the noise is attenuated.

14. The vehicle of claim 13 further comprising:

a bus communicating information regarding the component; and wherein the controller is further configured to identify the component from the information communicated on the bus.

15. The vehicle of claim 13 wherein:

the component is one of a switch, a closure, a compartment, a seat adjustor, a pedal, a gear selector, and a tactile interface.

* * * * *